United States Patent [19]

Bocchiaro

[11] 4,447,043

[45] May 8, 1984

[54] AUTOMATIC CABLE STOP FOR TOWING WINCH

[76] Inventor: Augustino Bocchiaro, 395 Blue Point Rd., Farmingville, N.Y. 11738

[21] Appl. No.: 417,989

[22] Filed: Sep. 14, 1982

[51] Int. Cl.[3] ..... B66D 1/56; B66D 1/48

[52] U.S. Cl. ..... 254/269; 200/61.14; 254/325; 254/390

[58] Field of Search ..... 200/61.14, 153 R; 254/269, 264, 282, 323, 325–328, 390; 318/468

[56] References Cited

U.S. PATENT DOCUMENTS 2,426,051 8/1947 Reiber ..... 200/61.14

2,661,405 12/1953 Western ..... 254/269

2,681,954 6/1954 King ..... 200/61.14

4,013,270 3/1977 Laky et al. ..... 254/269

*Primary Examiner*—Billy S. Taylor

*Attorney, Agent, or Firm*—Kevin Redmond

[57] ABSTRACT

An automatic cable stop for a tow truck winch having a bifurcated cable guide which rides on the cable and maintains contact even when the cable is positioned at an angle which does not correspond with that of the guide. A direct acting limit switch engages an extension of the cable eliminating complication and cost, as well as improving reliability.

5 Claims, 6 Drawing Figures

AUTOMATIC CABLE STOP FOR TOWING WINCH

BACKGROUND

1. Field

The present invention is related to automatic cable stops and, more particularly, to such stops as employed in tow winches.

2. Prior Art

A number of cable stop mechanisms are available as evidenced by U.S. Pat. Nos. 2,426,051, 3,904,843, 3,052,878, 4,273,973, 2,927,170, 3,056,586 and 2,681,954. All of these patents in some manner stop a cable automatically. However, none are specifically designed for use in tow truck winches. Normally, in the operation of a tow truck winch, the engine is used to drive the winch and the cable is reeled in over a pulley located at the end of the winch boom. The end of the cable usually contains a hook, such as hook 113 shown in FIG. 1. The end of the boom 101 is usually formed of two plates, such as plate 115 and 201, shown in FIG. 2. Securing means, such as 112 shown in FIGS. 1 and 2, the hook 113 and the tow bar are usually too large to pass between the plates 115 and 201 or cannot pass between the pulley 202 and a top cover of the boom (not shown). Continued reeling, once the hook and securing means have reached the end of the boom can cause serious damage to the boom, pulley and surrounding personnel in the event the cable snaps. A simple, low cost safety device is a current need for such winches.

Most of the prior art patents listed above describe cable stop mechanisms for special applications, but none is designed for the particular application of the tow truck winch. A number of the prior art cable stop devices include complicated mechanisms, and special housings which increase cost and, in some cases, reduce reliability. Finally, all of the prior art devices use lever mechanisms or other linkages to actuate the switch, further increasing complexity and cost while reducing reliability.

SUMMARY

It is an object of the present invention to provide an automatic stop for a winch cable in which a limit switch is positioned to make direct contact with the cable stop.

It is an object of the present invention to provide an automatic stop for a winch cable in which the cable is retained in a cable guide even when the angle of the cable is not coincident with that of the cable guide.

It is an object of the present invention to provide means for adjusting the position of the switch along the cable as well as means for quickly removing the invention from contacting the cable entirely.

It is an object of the present invention to provide an automatic cable stop in combination with a vehicle anti-theft device.

The principal elements of the present invention include an adjustable link, a switch and a cable guide. One end of the adjustable link is connected to the boom while the other end is connected to the switch and cable guide. The adjustable link adjusts the distance of the switch and guide away from the boom, while the guide holds the cable and positions the switch close to the cable to permit it to engage an extension of the cable. When the cable extension engages the switch, the switch disconnects power to the engine to prevent any further reel in of the cable.

The cable guide, which is designed to ride on the cable, includes a bifurcated ends with tines that hold the cable even when the cable axis is not coincident with the axis of the cable guide. The adjustable link is rotatably connected to the boom to permit rotation of the entire system to adjust to normal changes in cable angle. A second rotational connection at the lower end of the adjustable link permits positioning the entire assembly away from the cable for use of the winch without an automatic stop. Once the switch has been actuated, it disconnects electrical power to the engine to stop the winch. This feature also prevents movement of a vehicle, such as a tow truck which serves as the winch platform, and, in effect, functions as an anti-theft device which can be overridden by a remotely located auxiliary switch, when it is desired to use the vehicle.

Detailed Description of the Invention

Figure 3:
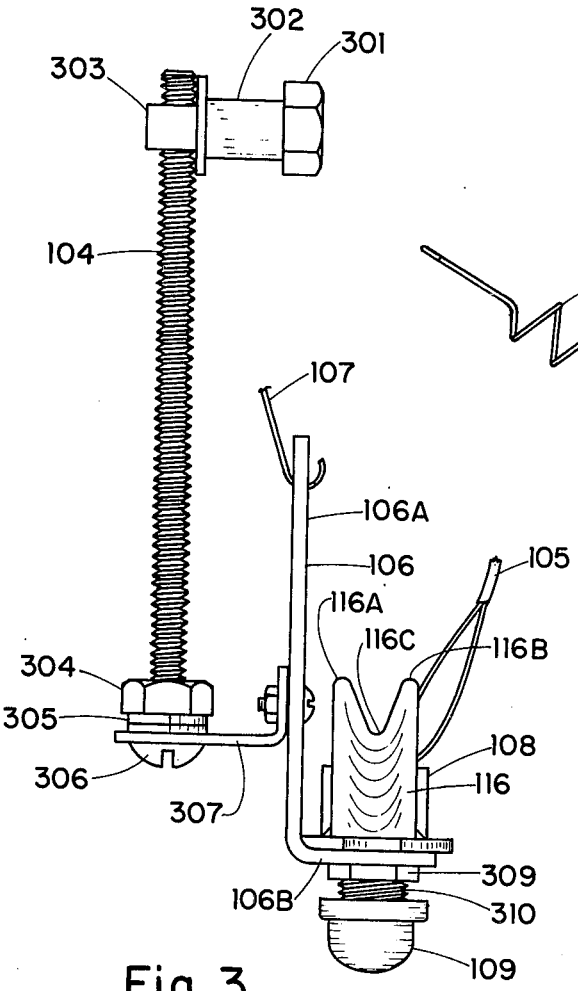
FIG. 3 is a front elevation view of the present invention.
Figure 4:
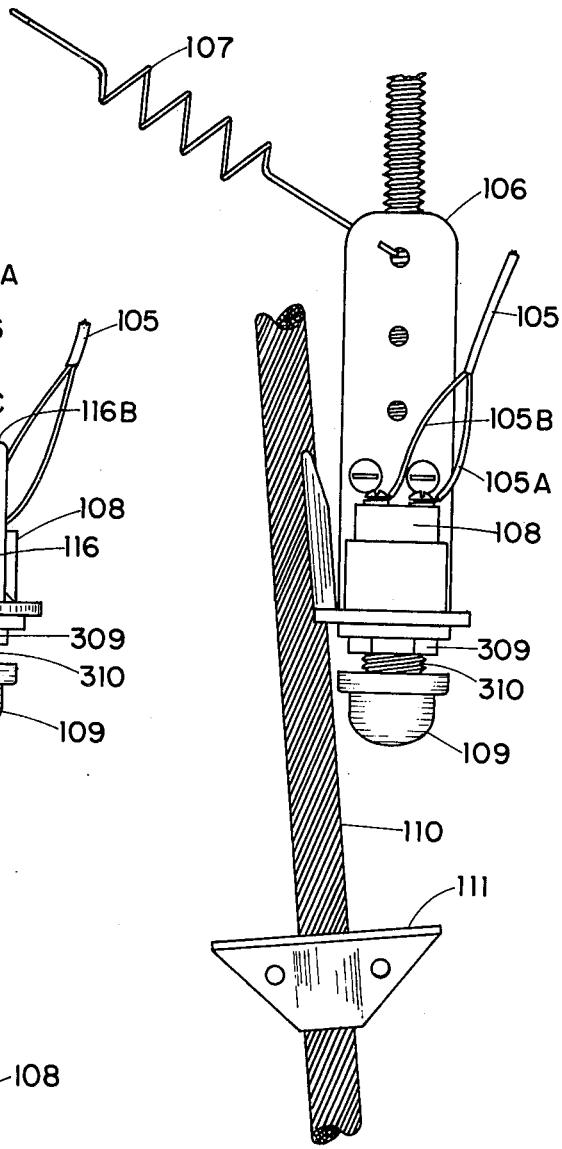
FIG. 4 is a side elevation view of the present invention, showing its position in relation to the cable.

A typical embodiment of the present invention is shown in FIGS. 3 and 4. This embodiment can be seen to comprise a bearing securing nut 301, a bushing 302, an adjustable link 104, a junction 303 for the adjustable link, an adjustment slot 306 for the adjustable link, a second nut 304 for the adjustable link 104, a washer 305, a connection bracket 307, a tension adjustment bracket 106, having a first portion 106A and a second portion 106B, a switch body 108 having a switch plunger 109 provided with a resilient protective cover projecting from the body, a switch line 105 which divide into individual leads 105A and 105B for connection to the switch terminals, and a cable guide 116 having a bifurcated end with tines 116A and 116B and a valley between the tines 116C.

Figure 5:
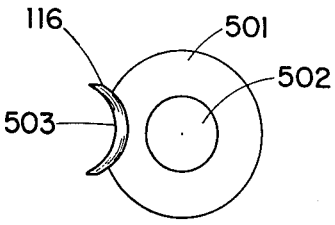
FIG. 5 is a top view of the cable guide of the present invention.

FIG. 5 is a top view of the cable guide assembly which shows the assembly to comprise a mounting base 501, a centrally located hole 502 in the mounting base and the guide 116 which exhibits an outward facing concave surface 503.

The mounting base 501 of the cable guide assembly is placed over the second portion of the tension adjustment bracket. The switch shank 310 is placed through the hole 502 and a similar hole (not shown) in the second portion of the tension adjustment bracket. The switch and guide are secured to the bracket by nut 309 which is threaded on the switch shank.

Figure 2:
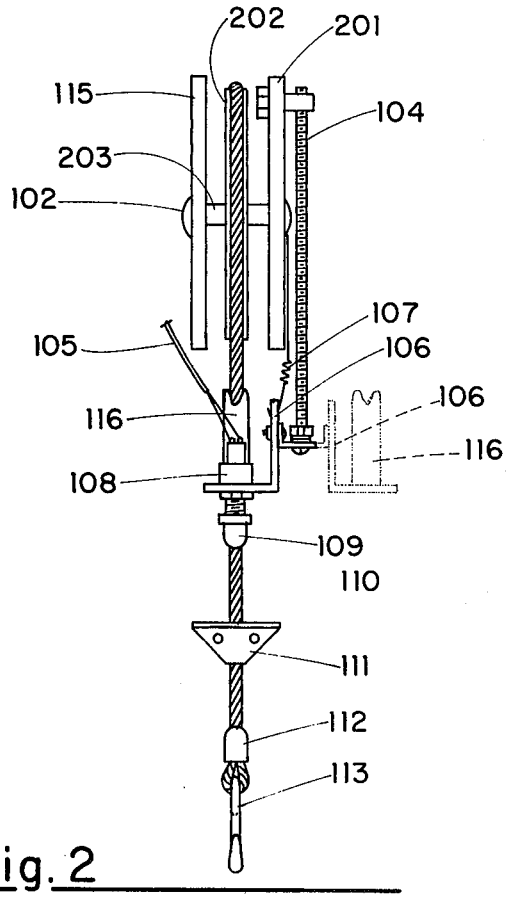
FIG. 2 is a front elevation view of the winch boom, illustrating the connection of the present invention.

The first portion of the tension adjusting bracket 106A is connected by the connection bracket 307 to an end of the adjustable link which is farthest from the boom by means of nut 304 and washer 305. Loosening this nut permits the switch and tension adjustment bracket to be rotated away from the cable as shown in FIG. 2 by the dashed lines. While this nut is loose, the adjustable link may be threaded through the junction 303 to vary the distance of the switch and guide away from the boom as desired.

The first portion of the tension adjustment bracket has a longitudinal axis passing through its ends which is positioned generally parallel to the axis of the adjustable link, but with a slight offset in angle as shown in FIG. 4 to enable the tines to obtain a better hold in the cable.

Figure 1:
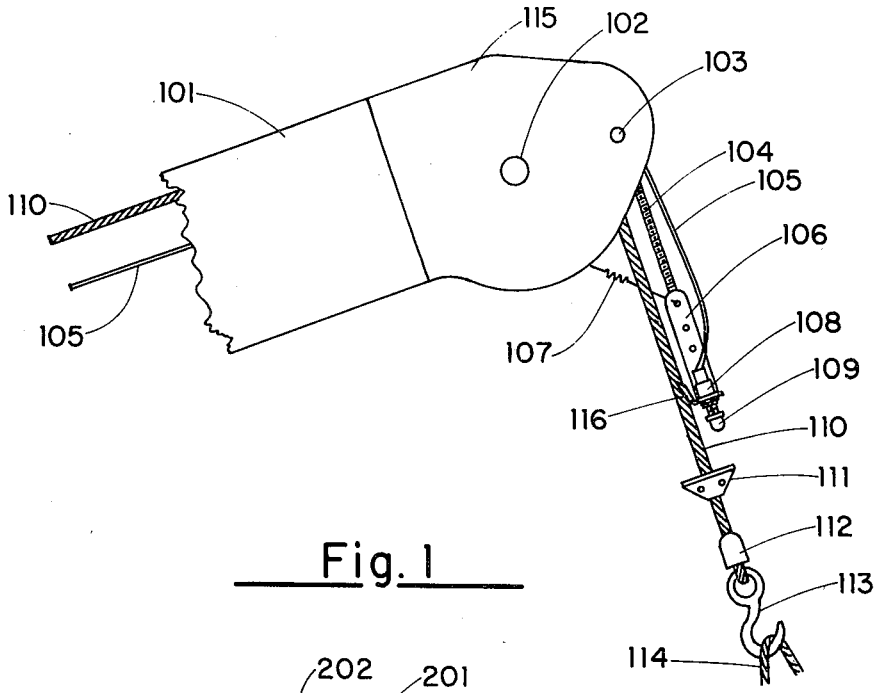
FIG. 1 is a side elevation view of a winch boom, illustrating the mounting of the present invention.

FIG. 1 shows the winch to include a boom 101 having a head plate 115, a pulley bearing termination 102, a port 103, a cable 110, a cable extension 111, hook securing means 112, and hook 113 which is shown carrying a load 114. The configuration of the present invention as described in connection with FIGS. 3 and 4 is shown in FIG. 1 as it is used with a winch. The present invention is connected to the boom by passing the bushing 302 through a port in one of the head plates similar to port 103 and securing a shaft (not shown) beneath the bushing in place by means of nut 301. A spring 107 is connected between the end of the boom and one of the holes in the tension adjustment bracket to draw the entire assembly towards the cable and, in particular, to hold the cable guide on the cable as shown. It can be seen in this Figure that the switch is placed in position to engage the cable extension 111 as the cable 110 is reeled in. The relative position of these components is shown in greater detail in FIG. 4.

FIG. 2 is a front elevation of the winch showing the head plate 115 located opposite a second head plate 201, a pulley axle 203 suspended between the head plates, a pulley 202 supported by pulley axle 203, and the present invention connected to the head plate 201 in the manner described above. The alternate position of the switch and bracket shown in dotted lines in this Figure is used when the automatically stop is not required.

In the operation of the present invention, the concave surface 503 of the cable guide 116 is positioned to ride on the cable 110 as shown in FIG. 4. As the cable is reeled in, the switch projection 109 is positioned to contact the cable extension 110. The cable extension forces the switch projection 109 inward causing the switch 108 to open, thereby breaking the contact between the leads 105A and 105B. Not shown is a connection from 105 to the engine at a point such as the supply to the ignition circuit, whereby a break in the contact would automatically shut off the tow truck engine and thereby disconnect power to the winch, stopping the winch from any further travel.

The cable guide is retained against the cable by means of the spring 107 which urges the tension adjustment bracket 106 and the entire mechanism including the cable guide against the cable. In the event the cable changes angle, the rotatable connection made by bushing 302 between the winch head plate 201 and the adjustable link 104 permits the entire assembly to ride up and down at various cable angles. However, in the event the cable is drawn slightly to the side to an angle which would make it difficult for the cable guide ordinarily to ride on the cable the bifurcated ends 116A and 116B tend to remain on the cable in the valley 116C of the cable guide because the valley is deeper than the concave surface 503 of the cable guide.

Figure 6:
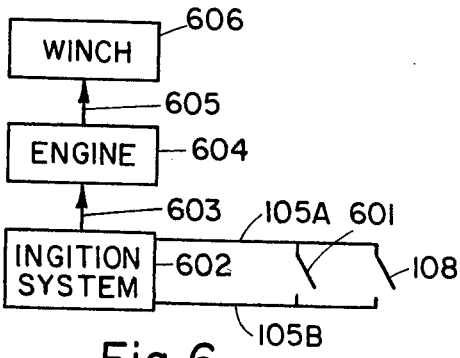
FIG. 6 is a schematic diagram of the switching connections used in the present invention for anti-theft purposes.

In normal use, when the cable and hook or tow bar are stored, the cable is wound up to a point where the cable extension holds the switch projection 109 in and thus shuts off the engine's ignition, preventing the tow truck from being operated. This feature can be used as an anti-theft device by merely placing an additional switch in parallel with the switch 108. The ignition can only be turned on by either releasing the tow bar or by throwing the auxiliary switch. A simple schematic diagram showing the parallel switches is presented in FIG. 6. In this Figure, leads 105A and 105B are connected to the ignition system 602 which in turn is connected to the engine 604 by connecting means 603. The engine is connected to the winch 606 by means of linkage 605 to supply power from the engine to the winch. Switch 108 is shown connected at the ends of leads 105A and 105B. A remotely located switch 601 is shown connected in parallel with switch 108 to provide the above mentioned anti-thieft feature.

Having described my invention, I claim:

1. Apparatus for automatically stopping the inward reeling of a tow truck cable by means of a powered winch before the end of the cable is reached to prevent damage to the winch longitudinally extending boom and injury to personnel in the area, comprising:

(a) first rotatable joint means secured to the outward end of the boom, (b) an adjustable link having a first and second end and a longitudinal axis passing through said ends, said adjustable link being connected at its first end to said first rotatable joint means, the adjustable link being adjustable in effective length between its first and second end, and being rotatable about the first rotatable joint means in a generally vertical plane that is parallel to the longitudinal axis of the boom, (c) a second rotatable joint connected to the second end of the first adjustable link, (d) a connecting link having a first and second end, the first end being connected to the second rotatable joint for rotation generally in a plane orthogonal to the longitudinal axis of said adjustable link, (e) a tension adjustment bracket having a first and a second portion, said portions both having a first and a second end, the two portions being positioned generally orthogonal to one another and being rigidly connected together at their first ends, said tension adjustment bracket having a plurality of holes along the length of its first portion between the first portions first and second end, and said tension adjustment bracket being rigidly connected at one of said holes to the second end of the connecting link to orient the first portion of the tension adjustment bracket generally parallel to the adjustable link, (f) a resilient means connected between an outward end of the boom and one of the holes in the tension adjustment bracket to draw the tension adjustment bracket towards the boom by rotating the entire apparatus about the first rotational joint means, (g) a cable guide means for riding on the cable, said cable guide having a first and a second end, a longitudinal axis between the ends and a concave surface in cross section orthogonal to the longitudinal axis, said concave surface encompassing at least a portion of the cable on its side away from the outward end of the boom and said cable guide means being connected at its first end to the second portion of the tension adjustment bracket, to position the longitudinal axis of the guide generally parallel to the longitudinal axis of the adjustable link, (h) a first switch means connected to the second portion of the tension adjustment bracket, said switch means having a projection for actuating the switch means, said projection extends beyond the cable guide means in a direction away from the boom with its longitudinal axis generally parallel to the longitudinal axis of the cable guide means, and adjacent thereto, said switch means being connected to disconnect power to the winch on being actuated by pressure against the projection along its longitudinal axis, and (i) a cable extension means secured about the cable at the point it is desired to automatically stop the reeling of the cable, said cable extension means extending radially outward of the cable to engage the switch projection and actuate the switch means as the cable is passed through the cable guide means.

2. Apparatus as claimed in claim 1, wherein said second end of said cable guide means is bifurcated resulting two edge located tines oriented generally parallel to the longitudinal axis of said cable guide means, the valley between the tines exceeding the depth of the concave surface of the cable guide means to retain the cable within the guide means when the orientation of the cable is not parallel with the longitudinal axis of the cable guide means.

3. Apparatus as claimed in claim 1, wherein said first switch means projection includes a cover of resilient material attached to the switch means to protect the switch means from damage due to engagement with the cable extension means.

4. Apparatus as claimed in claim 1, wherein said switch means is a normally closed electrical switch and the engaging of the cable extension means with the switch projection opens the first switch, said powered winch receiving its power from the engine of the tow truck and said first switch means being connected to interrupt the electrical power to the engine of the truck to stop the reeling of the cable upon engagement of the cable extension means and the switch projection.

5. Apparatus as claimed in claim 4, further comprising a second switch means connected electrically in parallel with said first switch means, said second switch means being positioned in a remote location on the truck to serve as an anti-theft device by preventing operation of the vehicle when the cable extension means has engaged the first switch means projection, unless the second switch means has been closed to permit electrical power to be supplied to the truck engine.

* * * * *